US006237155B1

(12) United States Patent
Seegar

(10) Patent No.: US 6,237,155 B1
(45) Date of Patent: May 29, 2001

(54) HAT WITH FRONT AND REAR LIGHT REFLECTIVE STRIPS

(76) Inventor: Howard Seegar, 41185 Raintree Ct., Murrieta, CA (US) 92562

( * ) Notice: Subject to any disclaimer, the term of this patent is extended or adjusted under 35 U.S.C. 154(b) by 0 days.

(21) Appl. No.: 09/631,144

(22) Filed: Aug. 2, 2000

(51) Int. Cl.[7] ..... A42B 1/00
(52) U.S. Cl. ..... 2/175.1; 2/195.1; 2/209.12
(58) Field of Search ..... 2/195.1, 209.12, 2/209.13, 175.1; 362/105, 106

(56) References Cited

U.S. PATENT DOCUMENTS

| | | | |
|---|---|---|---|
| 291,033 | 1/1884 | Couch . | |
| 3,038,381 | 6/1962 | Jones | 88/80 |
| 3,172,942 | 3/1965 | Berg | 88/82 |
| 3,577,561 | 5/1971 | Oshima | 2/3 |
| 3,885,246 | 5/1975 | Tung | 2/3 R |
| 4,008,949 | 2/1977 | Luna | 350/98 |
| 4,517,685 | 5/1985 | Lesley | 2/170 |
| 5,159,718 | 11/1992 | Moyer | 2/69 |
| 5,588,156 | 12/1996 | Patton, Jr. | 2/243.1 |
| 5,933,871 | 8/1999 | Kraft | 2/209.13 |

*Primary Examiner*—Bibhu Mohanty
(74) *Attorney, Agent, or Firm*—Flanagan & Flanagan; John R. Flanagan; John K. Flanagan

(57) ABSTRACT

A light reflective hat includes a crown contoured for covering a part of a user's head when the hat is worn and having a rear side with an interior edge of a substantially inverted U-shaped configuration defining a gap allowing the crown to be expanded and contracted, a rear light reflective strip attached to and extending along the interior edge of the rear side of the crown in a substantially inverted U-shaped configuration about the gap, a visor attached at a rear peripheral edge to a lower edge of and along a front side of the crown such that the visor extends outwardly from the front side of the crown, and a front reflective strip attached to and extending along the front peripheral edge of the visor.

14 Claims, 3 Drawing Sheets

HAT WITH FRONT AND REAR LIGHT REFLECTIVE STRIPS

BACKGROUND OF THE INVENTION

1. Field of the Invention

The present invention generally relates to devices which reflect light rays and, more particularly, is concerned with a hat, such as a ball cap, with front and rear light reflective strips.

2. Description of the Prior Art

Activities, such as working, jogging, and walking, undertaken at dusk, night-time or in a darkened area with limited visibility require participants to take sufficient precautions in order to avoid injury. With the increasing numbers of persons who partake in outdoor activities at such times, attempts have been made to provide articles which will provide a degree of visibility which is not otherwise present. For example, as shown in U.S. Pat. No. 4,517,685 to Lesley, light reflective material has been used in the prior art such as thin cloth bands variously attached at the wrist, ankle and head portions of the wearer.

Also, hats, such as ball caps, are popular articles that are worn by participants during these outdoor activities. FIG. 1 shows a typical prior art ball cap A which has a pair of light reflective strips B attached exteriorly on the opposite sides (only one side being shown) of a cap piece or crown C of the cap A which end at the interior edge D on opposite sides of a gap E defined in the rear side of the crown C of the cap A.

However, many of the prior art articles of wearing apparel on which light reflective strips have been implemented are less than satisfactory in their appearance as well as comfort, durability and reliability. Further, such prior art attempts have often yielded articles of wearing apparel which are lacking in aesthetic appeal and thus may not worn when needed to ensure the safety of the participant.

Consequently, a need still exists for an approach which will provide a solution to the aforementioned problem in the prior art without introducing any new problems in place thereof.

SUMMARY OF THE INVENTION

The present invention provides a light reflective hat designed to satisfy the aforementioned need. The hat of the present invention, preferably being a ball cap, provides light reflective strips at locations thereon which provide for the visibility of reflected light in all directions from the cap without compromising the aesthetic appeal of the cap as a popular article of wearing apparel.

Accordingly, the present invention is directed to a light reflective hat which comprises a crown contoured for covering a part of a user's head when the hat is worn, a visor disposed exteriorly of and attached to the crown at a lower edge of the crown such that the visor extends outwardly from the crown, and a first light reflective strip attached to and extending along a portion, preferably an outer or front peripheral edge, of the visor. The crown has a front side and a rear side opposite from the front side. The rear side of the crown has an interior edge of a substantially inverted U-shaped configuration which defines a gap allowing the crown to be expanded and contracted. The hat also comprises a second light reflective strip attached to and extending along the interior edge of the rear side of the crown in a substantially inverted U-shaped configuration about the gap.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 7:
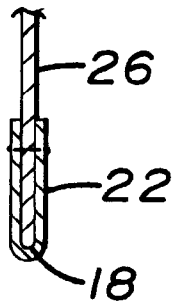
FIG. 7 is an enlarged cross-sectional view taken along line 7—7 through the peripheral edge of rear gap of the cap of FIG. 5.

Referring to the drawings and particularly to FIGS. 2–5, there is illustrated a light reflective hat, generally designated 10, of the present invention, preferably but not necessarily in the form of a ball cap. Basically, the cap 10 includes a crown 12 contoured for covering a part of a user's head when the hat 10 is worn, a visor 14 disposed exteriorly of and attached to the crown 12 at a lower edge 12A of the crown 12 such that the visor 14 extends outwardly from the crown 12, and a first or front light reflective strip 16 attached to and extending along a portion, preferably an outer or front peripheral edge 14A, of the visor 14. The crown 12 has a front side 12B and a rear side 12C opposite from the front side 12B. The rear side 12C of the crown 12 has an interior edge 18 of a substantially inverted U-shaped configuration which defines a gap 20 that allows the crown 12 to be expanded and contracted to fit users' heads of different sizes. The hat 10 also includes a second or rear light reflective strip 22 attached to and extending along the interior edge 18 of the rear side 12C of the crown 12, as seen in FIG. 7, in a substantially inverted U-shaped configuration about the gap 20 which matches the configuration of the interior edge 18. The front and rear light reflective strips 16, 22 are thus provides at locations on the hat 10 which permits visibility of reflected light in all directions from the hat 10.

Referring still to FIGS. 2–5, the front side 12B of the crown 12 is composed of a pair of solid flexible triangular-shaped panels 24 attached side-by-side to one another and the rear side 12C of the crown 12 is composed of a pair of solid flexible triangular-shaped panels 26 attached side-by-side to one another. The interior edge 18 forming the gap 20 is defined in the panels 26 of the rear side 12C of the crown 12. The crown 12 also has left and right sides 12D, 12E which are respectively composed of one or more solid flexible triangular-shaped panels 28, 30. Alternatively, one or more of the panels 24–30 can have a perforated instead of a solid construction. The respective panels 28, 30 of the left and right sides 12D, 12E which are disposed opposite from one another extend between and interconnect the respective panels 24, 26 of the front and rear sides 12B, 12C of the crown 12.

Referring to FIGS. 2–4 and 6, the visor 14 has a main panel 32 which is flexible but more rigid than the panels 24–30 of the respective sides 12B–12E of the crown 12, and top and bottom cover sheets 34, 36 attached to and covering upper and lower surfaces 32A, 32B of the main panel 32. Spaced opposite from its outer or front peripheral edge 14A, the visor 14 has an inner or rear peripheral edge 14B. The visor 14 is disposed exteriorly of and attached along its inner or rear peripheral edge 14B to the crown 12 at the lower edge 12A thereof. In the case where the visor 14 of the hat 10 is a bill on a ball cap, the visor 14 extends about the front side 12B of the crown 12 and partially along each of the left and right sides 12D, 12E thereof. Also, the visor 14 extends forwardly from the crown 12 such that the front peripheral edge 14A of the visor 14 extends forwardly from the opposite ends of the rear peripheral edge 14B of the visor 14. In the case where the hat 10 has a continuous visor 14, the outer peripheral edge 14A encompasses the inner peripheral edge 14B and can be generally concentric therewith.

Figure 1:
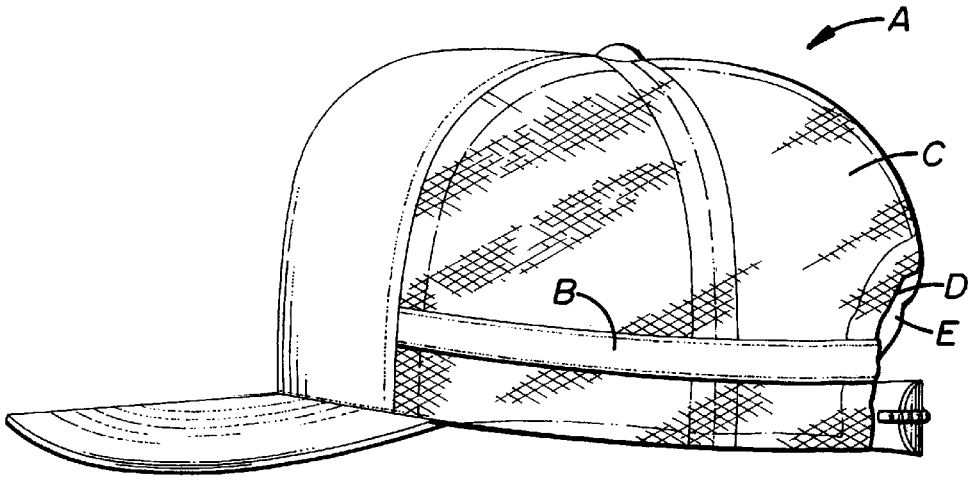
FIG. 1 (PRIOR ART)
FIG. 1 is a side elevational view of a prior art hat in the form of a ball cap having a light reflective strip on each of opposite sides of the cap.
Figure 2:
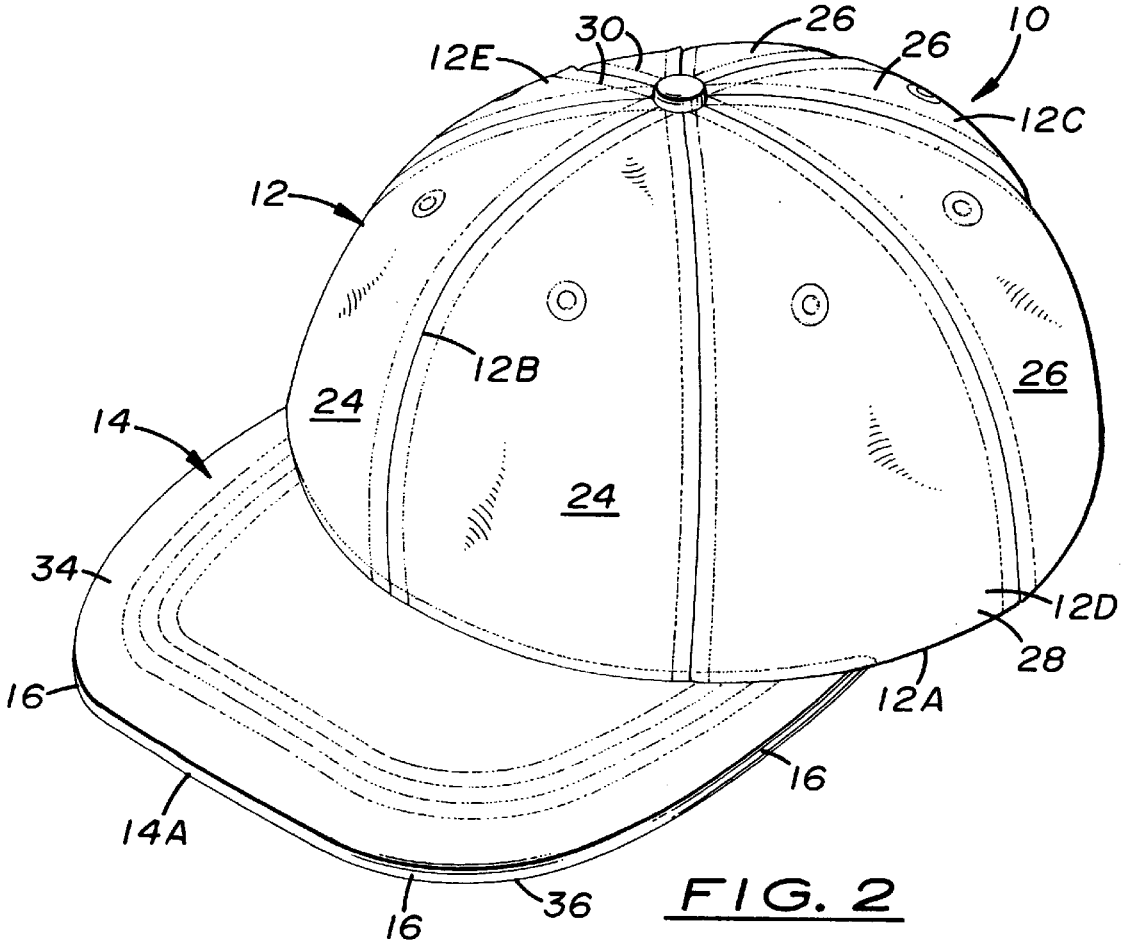
FIG. 2 is a perspective view of a light reflective hat of the present invention in the form of a ball cap having light reflective strips along peripheral edges of a bill or visor and a rear gap of the cap.
Figure 3:
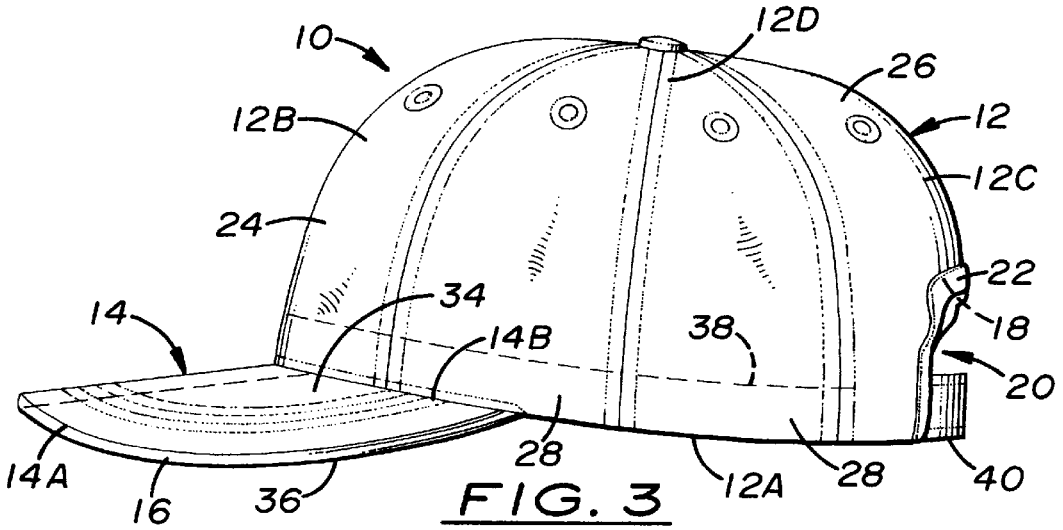
FIG. 3 is a side elevational view of the cap of FIG. 2.
Figure 4:
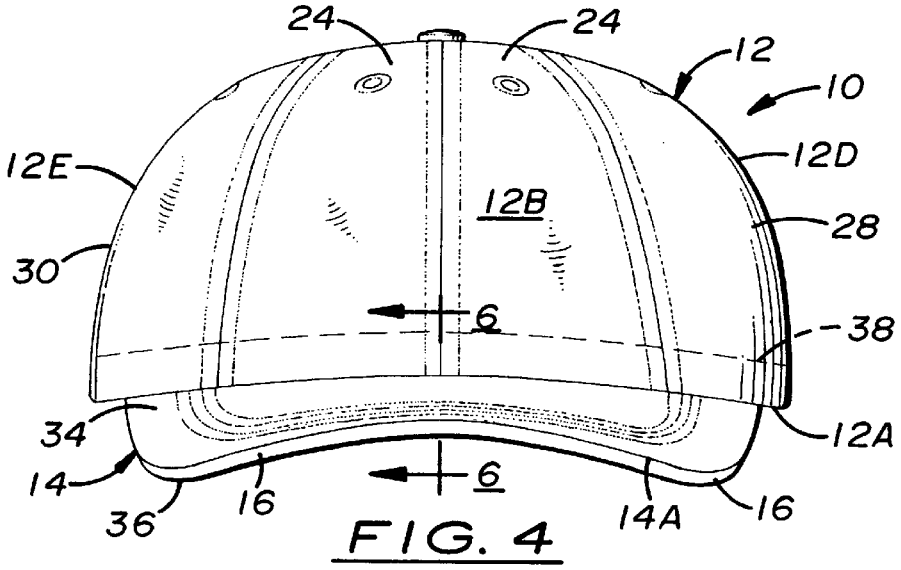
FIG. 4 is a front elevational view of the cap as seen along line 4—4 of FIG. 3.
Figure 5:
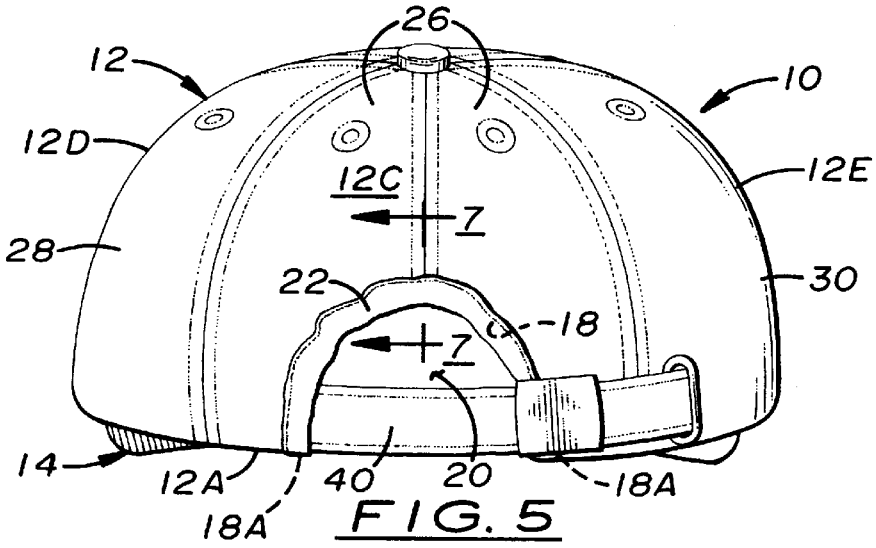
FIG. 5 is a rear elevational view of the cap as seen along line 5—5 of FIG. 3.
Figure 6:
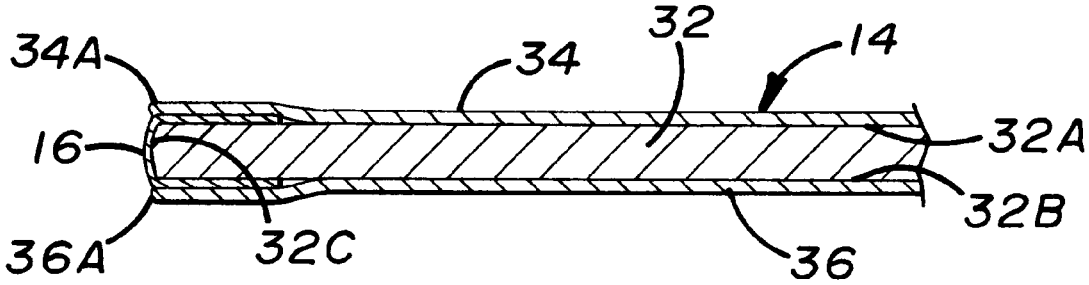
FIG. 6 is an enlarged cross-sectional view taken along line 6—6 through the visor of the cap of FIG. 4.

As best seen in FIG. 6, the main panel 32 has a front peripheral edge 32C disposed between and spacing apart peripheral edges 34A, 36A of the top and bottom cover sheets 34, 36. The first or front light reflective strip 16 is attached to and extending along the front peripheral edge 14A of the visor 14 and about the front peripheral edge 32C of the main panel 32 and between the spaced apart peripheral edges 34A, 36A of the top and bottom cover sheets 34, 36.

The hat 10 also includes a band 38 and an adjustable strap 40. The band 38 is disposed interiorly of the crown 12 and attached to all of the sides 12B–12E thereof along the lower edge 12A of the crown 12 which is defined by all of the sides 12B–12E and terminate at lower ends 18A of the interior edge 18 of the rear side 12C. The adjustment strap 40 is mounted to the lower ends 18A of the interior edge 18 of the rear side 12C and extends across the gap 20 of the rear side 12C for adjusting the distance across the gap 20 of the rear side 12C to thereby adjust the fit of the crown on the user's head.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A light reflective hat, comprising:

(a) a crown contoured for covering a part of a user's head when the hat is worn, said crown having a front side and a rear side opposite from said front side, said rear side having an interior edge of a substantially inverted U-shaped configuration which defines a gap allowing said crown to be expanded and contracted;

(b) a visor disposed exteriorly of and attached to said crown at a lower edge of and along said front side of said crown such that said visor extends outwardly from said front side of said crown; and (c) a rear light reflective strip attached to and extending along said interior edge of said rear side of said crown in a substantially inverted U-shaped configuration about said gap.

2. The hat of claim 1 further comprising:

an adjustment strap mounted to opposing lower ends of said interior edge of said rear side and extending across said gap of said rear side for adjusting the distance across said gap of said rear side to thereby adjust the fit of said crown on the user's head.

3. The hat of claim 1 wherein said rear side of said crown is composed of a pair of solid flexible triangular-shaped panels attached side-by-side to one another, said panels having said gap and said interior edge defined therein.

4. The hat of claim 1 wherein said front side of said crown is composed of a pair of solid flexible triangular-shaped panels attached side-by-side to one another.

5. The hat of claim 1 wherein said crown further includes:

a left side composed of at least one of solid flexible triangular-shaped panel disposed between and attached to said front and rear sides; and a right side composed of at least one of solid flexible triangular-shaped panes disposed opposite from said left side and between and attached to said front and rear sides.

6. The hat of claim 5 wherein said crown further includes a band disposed interiorly of the crown and attached to all of the sides along a lower edge of the crown defined by all of the sides and terminating at lower ends of the interior edge of the rear side.

7. The hat of claim 5 wherein said visor having a main panel and top and bottom cover sheets attached to and covering upper and lower surfaces of said main panel, the visor having a rear peripheral edge and a front peripheral edge extending from the rear peripheral edge, said visor disposed exteriorly of and attached along said rear peripheral edge to said front side of said crown at said lower edge of said crown and about said front side and partially along each of said left and right sides thereof, said visor extending forwardly from said crown such that said front peripheral edge of said visor extends forwardly about said visor from said lower edge of said crown between said left and rear sides thereof, said main panel of said visor having a front peripheral edge disposed between and spacing apart peripheral edges of said top and bottom cover sheets.

8. The hat of claim 7 further comprising:

a front reflective strip attached to and extending along said front peripheral edge of said visor about said front peripheral edge of said main panel between said spaced apart peripheral edge of said top and bottom cover sheets thereof.

9. A light reflective hat, comprising:

(a) a crown contoured for covering a part of a user's head when the hat is worn, said crown having a front side and a rear side opposite from said front side, said rear side having an interior edge of a substantially inverted U-shaped configuration which defines a gap allowing said crown to be expanded and contracted;

(b) a rear light reflective strip attached to and extending along said interior edge of said rear side of said crown in a substantially inverted U-shaped configuration about said gap;

(c) a visor having a rear peripheral edge and a front peripheral edge and being disposed exteriorly of and attached at said rear peripheral edge thereof to said crown at a lower edge of and along said front side of said crown such that said visor extends outwardly from said front side of said crown; and (d) a front reflective strip attached to and extending along said front peripheral edge of said visor.

10. The hat of claim 9 further comprising:

an adjustment strap mounted to opposing lower ends of said interior edge of said rear side and extending across said gap of said rear side for adjusting the distance across said gap of said rear side to thereby adjust the fit of said crown on the user's head.

11. The hat of claim 9 wherein said crown further includes:

a left side disposed between and attached to said front and rear sides; and a right side disposed opposite from said left side and between and attached to said front and rear sides.

12. The hat of claim 11 wherein said crown further includes a band disposed interiorly of the crown and attached to all of the sides along a lower edge of the crown defined by all of the sides and terminating at lower ends of the interior edge of the rear side.

13. The hat of claim 9 wherein said visor having a main panel and top and bottom cover sheets attached to and covering upper and lower surfaces of said main panel, the visor having a rear peripheral edge and a front peripheral edge extending from the rear peripheral edge, said visor disposed exteriorly of and attached along said rear peripheral edge to said front side of said crown at said lower edge of said crown and about said front side and partially along each of said left and right sides thereof, said visor extending forwardly from said crown such that said front peripheral edge of said visor extends forwardly about said visor from said lower edge of said crown between said left and rear sides thereof, said main panel of said visor having a front peripheral edge disposed between and spacing apart peripheral edges of said top and bottom cover sheets.

14. The hat of claim 13 wherein said front reflective strip is attached to and extends along said front peripheral edge of said visor about said front peripheral edge of said main panel between said spaced apart peripheral edge of said top and bottom cover sheets thereof.

* * * * *